US009260876B1

(12) United States Patent
Brown

(10) Patent No.: US 9,260,876 B1
(45) Date of Patent: Feb. 16, 2016

(54) PORTABLE TOILETS AND PORTABLE RESTROOM ARRANGEMENTS

(71) Applicant: John T. Brown, Liberty, NC (US)

(72) Inventor: John T. Brown, Liberty, NC (US)

(73) Assignee: Porta-Can & Bottle Holdings LLC, Greensboro, NC (US)

( * ) Notice: Subject to any disclaimer, the term of this patent is extended or adjusted under 35 U.S.C. 154(b) by 64 days.

(21) Appl. No.: 14/190,714

(22) Filed: Feb. 26, 2014

Related U.S. Application Data

(60) Provisional application No. 61/769,356, filed on Feb. 26, 2013.

(51) Int. Cl.

| | |
|---|---|
| ***A47K 4/00*** | (2006.01) |
| ***E04H 1/12*** | (2006.01) |
| ***A47K 11/04*** | (2006.01) |
| ***A47K 11/12*** | (2006.01) |

(52) U.S. Cl.
CPC ..... *E04H 1/1216* (2013.01); *A47K 11/04* (2013.01); *A47K 11/12* (2013.01)

(58) Field of Classification Search
CPC ..... A47K 11/02
USPC ..... 4/449–486
See application file for complete search history.

(56) References Cited

U.S. PATENT DOCUMENTS

| | | | | | |
|---|---|---|---|---|---|
| 3,066,311 | A * | 12/1962 | Tharp | A47K 4/00 | 4/449 |
| 3,629,874 | A * | 12/1971 | Beller | E04H 1/1216 | 4/462 |
| 3,992,727 | A * | 11/1976 | Elkins | E03D 13/00 | 280/47.31 |
| 5,437,065 | A * | 8/1995 | Sakawa | E04H 1/1266 | 4/342 |
| 6,349,426 | B1 * | 2/2002 | Wieringa | A47K 11/02 | 4/449 |
| 6,374,432 | B1 * | 4/2002 | Morris | A47K 11/12 | 4/144.1 |
| 6,418,672 | B1 * | 7/2002 | Hampel | E04H 1/1216 | 4/460 |
| 6,668,392 | B2 * | 12/2003 | Mason | E04H 1/1216 | 4/449 |
| 6,997,204 | B2 * | 2/2006 | Sansom | E03C 1/122 | 137/14 |
| D519,645 | S * | 4/2006 | Wright | E03C 1/122 | D25/16 |
| 2003/0121093 | A1 * | 7/2003 | Braxton | E04H 1/1216 | 4/476 |
| 2012/0144576 | A1 * | 6/2012 | Taylor | A47K 11/00 | 4/476 |

FOREIGN PATENT DOCUMENTS

| | | |
|---|---|---|
| ZA | 201206940 | 11/2013 |

OTHER PUBLICATIONS

Giep Van Zyl: "1671AP Stacking Hut C/W Bench", http://www.autospec.co.za/productmedia/atlasplastics/images/1671ap_stacking_hut.pdf, Feb. 8, 2013.

Callahead: "The HeadMaster Flushing Portable Toilet", http://www.callahead.com/portable-toilets/head-master/head-master.html.

Kathy Prentice: "Getting your message before folks on the go", http://www.medialifemagazine.com:8080/news2001/mar01/mar26/1_mon/news5monday.html, Media Life, 2001.

* cited by examiner

*Primary Examiner* — Lori Baker
(74) *Attorney, Agent, or Firm* — NK Patent Law, PLLC

(57) ABSTRACT

Portable toilet and schematic toilet arrangements are provided. In one arrangement, the portable toilet comprises a lower toilet shelter and an upper removable conical roof. In another arrangement, the portable toilet includes a lower toilet shelter with an indented upper ledge and a ribbed ceiling. Additional portable toilet arrangements may include a plurality of rounded toilet shelters.

22 Claims, 6 Drawing Sheets

PORTABLE TOILETS AND PORTABLE RESTROOM ARRANGEMENTS

This application claims the benefit of U.S. provisional application No. 61/769,356, filed Feb. 26, 2013, which is incorporated herein by reference in its entirety.

FIELD OF THE TECHNOLOGY

The present disclosure relates generally to toilet buildings, and more particularly to improved portable toilet shelters and portable restroom shelter schematic arrangements.

BACKGROUND

Portable toilets are free-standing structures having minimal enclosures for use as temporary toilets. Portable toilets are widely used at various events, such as sporting events, festivals, concerts and a variety of other large gatherings of people. Typically, portable toilets include an open-front U-shaped toilet seats with a cover. The toilet is generally gravity fed into a waste tank. Often the waste tank includes a chemical disinfectant to minimize unappealing odors and the like.

Portable toilets are efficient for handling the needs of large gatherings, however they are often eyesores or otherwise diminish the aesthetics of the event. Similarly, the footprints of traditional portable toilets are large and unappealing to event planners and patrons, and may distract from adjacent advertising.

Therefore, Applicants desire systems and methods for appealing portable toilet shelters and schematic arrangements without the drawbacks presented by the traditional systems and methods.

SUMMARY

In accordance with the present disclosure, portable toilets and schematic toilet arrangements are provided for various uses. This disclosure provides improved toilet structures and arrangements that are convenient, efficient, and safe, particularly when used for large gatherings of people. This disclosure may also allow for branding and advertisement avenues.

In one embodiment of the present disclosure, a portable restroom arrangement includes a first, second, and third rounded portable toilet shelter spaced apart in a first row; and a fourth, fifth, and sixth rounded portable toilet shelter spaced apart in a second row. In one example, the first row and the second row may be positioned substantially opposing one another with the doors aligning outward. In one example, the rear of the first shelter is typically substantially adjacent a rear of the forth shelter. The rear of the second shelter is typically substantially adjacent a rear of the fifth shelter. The rear of the third shelter is typically substantially adjacent a rear of the sixth shelter. Typically, each of the shelters includes a rounded sidewall housing with a door and a removable tapered roof. In some examples, each of the toilet shelters may include a closed receptacle holding tank, a toilet seat having a port aligned with the holding tank, and a ceiling having a female shelter connector. In addition, each of the toilet shelters may include an upper conical roof having a male roof connector, and wherein the male roof connector removably aligns over the female shelter connector to define a bottle shape in an assembled position.

Another embodiment of the present disclosure includes a portable toilet comprising a lower toilet shelter and an upper conical-like roof. Typically, the lower toilet shelter has a rounded sidewall. The shelter may include a closed receptacle holding tank, a toilet seat having a port aligned with the holding tank, a door, and a ceiling having a female shelter connector. Typically, the upper conical roof has a male roof connector. Further, the male roof connector is generally adapted to removably align over the female shelter connector to define a bottle shape in an assembled position.

In some examples, the rounded sidewall includes a smooth surface comprising an outer body wrap. The outer body wrap may include wrap chosen from a label, an advertisement, a scenic view and combination thereof. The conical roof may include an upper tapered edge. Further, the conical roof may include a lower squared edge. The door may be reversible. Further, the door may include a plurality of hinges. The door may include a handle. A urinal may be in fluid communication with the holding tank. In addition, the base may include a non-skid floor material.

In yet other examples, a quick connect assembly may removably secure the lower toilet shelter and the upper conical roof. For instance, the quick connect assembly may include male connectors, female connectors and/or fasteners securing the lower toilet shelter and the upper conical roof.

Another embodiment of the disclosure includes a portable toilet comprising a lower toilet shelter with an indented ledge and a ceiling. Typically, the lower toilet shelter includes a rounded sidewall. The shelter may include a closed receptacle holding tank, a toilet seat having a port aligned with the holding tank, and a door. Typically, the indented ledge is positioned on the upper ends of the sidewall. Further, the ceiling is generally adjacent to the indented ledge. The ceiling may include rib supports that extend axially from a center tab.

In some examples, the portable toilet defines a drinking can shape. The rounded sidewall may include a smooth surface having an outer body wrap. The outer body wrap may include a wrap chosen from a label, an advertisement, a scenic view and combination thereof. The door may be reversible. Further, the door may include a plurality of hinges. The door may include a handle. A urinal may be in fluid communication with the holding tank. In addition, the base may include a non-skid floor material.

Yet another embodiment of the present disclosure includes a portable restroom arrangement. The arrangement may include a first, second and third rounded portable toilet shelter spaced apart in a first row, and a forth, fifth and sixth rounded portable toilet shelter spaced apart in a second row. Those of ordinary skill in the art having the benefit of this disclosure will recognize that fewer or greater than six shelters may be arranged together in a particular arrangement using any of the elements described herein. Typically, the portable toilet shelters have rounded sidewall housing with a door and a removable tapered roof. Further, the first row and said second row may be positioned substantially opposing one another with the doors aligning outward. In this example, the rear of the first shelter is substantially adjacent a rear of the forth shelter, the rear of the second shelter is substantially adjacent the rear of the fifth shelter, and the rear of the third shelter is substantially adjacent the rear of the sixth shelter.

Still another embodiment of the present disclosure includes portable toilet arrangements having a plurality of rounded portable toilet shelters. In particular examples, each of the portable toilet shelters have a lower toilet housing with a door and an upper tapered roof. In other examples, each portable toilet shelter includes any of the drinking can-shaped toilets shown and described herein. In these examples, the plurality of rounded portable toilet shelters are aligned in two adjacent rows whereby the doors align outward from the adjacent rows.

A still further embodiment of the present disclosure includes materials for assemblage into a portable toilet. The materials may include a lower toilet shelter having a rounded sidewall and a conical roof. The kit may include a closed receptacle holding tank, a toilet seat having a port aligned with the holding tank, a door, and a ceiling. Typically, the conical roof has an upper tapered edged and a lower squared edge. Other kits include any of the drinking can-shaped toilet elements shown and described herein.

The above summary was intended to summarize certain embodiments of the present disclosure. Embodiments will be set forth in more detail in the figures and description of embodiments below. It will be apparent, however, that the description of embodiments is not intended to limit the present inventions, the scope of which should be properly determined by the appended claims.

BRIEF DESCRIPTION OF THE DRAWINGS

Embodiments of the disclosure will be better understood by a reading of the Description of Embodiments along with a review of the drawings, in which.

DESCRIPTION OF EMBODIMENTS

Figure 1:
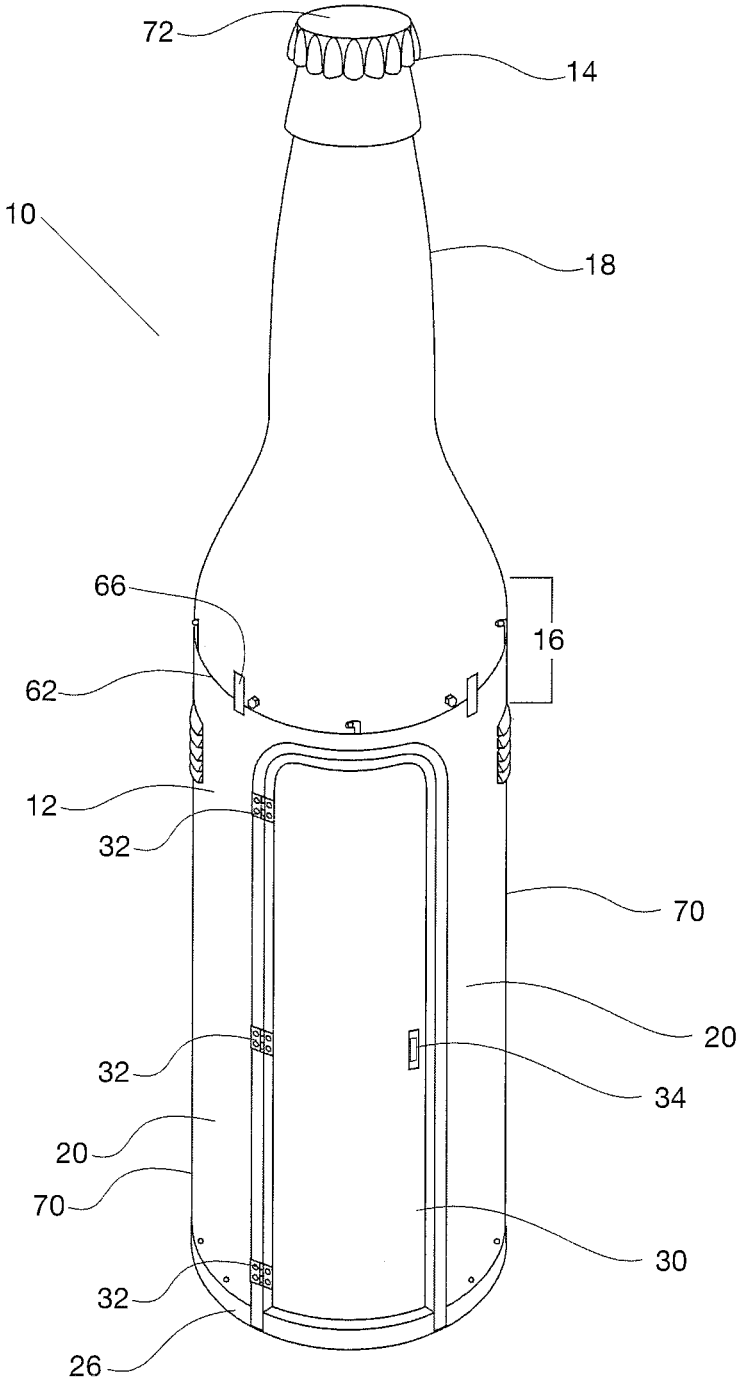
FIG. 1 is a front perspective view of a portable toilet according to one embodiment of the disclosure.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Figure 3:
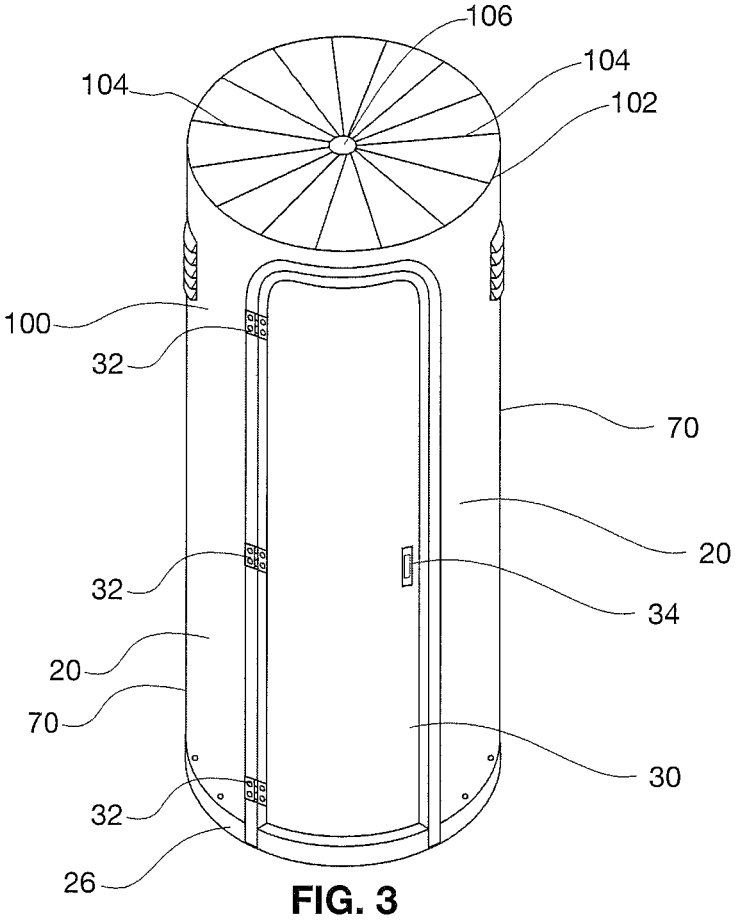
FIG. 3 is a front perspective view of another portable toilet embodiment of the disclosure.

Referring now to the drawings in general and FIG. 1 in particular, it will be understood that the illustrations are for the purpose of describing embodiments of the disclosure and are not intended to limit the disclosure or any inventions thereto. As best seen in FIGS. 1 and 3, portable toilets 10, 100 are respectively shown embodied according to the present disclosure. As shown in FIG. 1, portable toilet 10 includes a lower toilet shelter 12 having a rounded sidewall and a removable conical-like shaped roof 14 with a flat upper surface. The assembled lower toilet shelter 12 and conical roof 14 imitate the appearance of a drinking bottle or the like, as discussed herein. As shown in FIG. 3, portable toilet 100 includes a lower toilet shelter 12 having a rounded sidewall and a ribbed ceiling 104 above an indented ledge 102. Similarly, the assembled lower toilet shelter 12 and conical roof 14 in the portable toilet 100 imitates the appearance of a drinking can or the like, as discussed herein. Typically, the portable toilet 10 and portable toilet 100 includes a body wrap 70.

As shown in FIG. 1, portable toilet 10 typically includes a free-standing lower toilet shelter 12 and an upper roof 14. The lower toilet shelter 12 includes a generally rounded, including cylindrical, sidewall 20 supported above a base 26 to fully enclose the shelter. The base 26 may be constructed of solid plastic and is generally adapted to be lifted, for instance by a forklift or the like, and positioned into place, including any of the schematic arrangements shown and described herein. Other sidewall embodiments include other non-rectangular shaped designs. As illustrated, the outer face of the sidewall 20 may be flat or smooth to retain a removable, or permanent, body wrap 70. The body wrap 70 may fully, or partially, encircle the sidewall 20. In particular examples, body wrap 70 is removably secured to the sidewall, for instance with adhesives, fasteners and the like. In yet other examples, the body wrap 70 is inserted into a protective sleeve (not shown) along the sidewall 20. Any of the body wrap 70 examples discussed herein may include advertisements, labeling, color or scenic schemes and the like to create a marketing and/or aesthetically-pleasing appearance. The lower toilet shelter 12 includes a door 30 to the interior housing. In some examples, the door opening is about seventy-five inches high and about twenty-six inches wide. The door 30 may be reversible, so as to allow both right-sided and left-sided entry, depending on the particular schematic arrangement. The door 30 may include one or a plurality of hinges 32, or the like, so that the door may be hingedly opened from one side. The hinges 32 may be fastened to the toilet shelter 12 with fasteners, but may also be integrally fastened thereto using a variety of thermoforming or heat lamination techniques. Further, the door 30 may include a handle 34. Again, the handle 34 may be repositionable along the door 30 to meet the particular usage, including any of the portable toilet schematic arrangements shown and described herein.

As shown in FIG. 1, the upper roof 14 is generally tapered to imitate the top of a drinking bottle, for instance a beer bottle, wine bottle or the like. In particular examples, the roof 14 is generally conical in shape with slight tapered edges and a substantially flat upper surface. As illustrated, the upper roof 14 may have a generally tapered edge 18 leading away from its distal end, while the proximate end may include a generally squared ledge leading to the toilet shelter 12.

Typically, the conical roof 14 is removebably secured to the lower toilet shelter 12. The removable roofs 14 may be stackable for efficient transport between locations. However, other examples include arrangements where the tapered roof 14 is permanently secured to the lower toilet shelter 12. A quick connection assembly 16 may provide efficient assembly and disassembly during maintenance. Typically, in an assembled position, the male roof connector 62 is aligned over the female shelter connector (shown in FIG. 2A). In particular examples, fasteners 66 further secure the upper roof 14 to the lower toilet shelter 12 in an assembled position. Those of ordinary skill in the art having the benefit of this disclosure will recognize that the fasteners 66 may be screws, rivets, thermoformed members or the like.

Figure 2A:
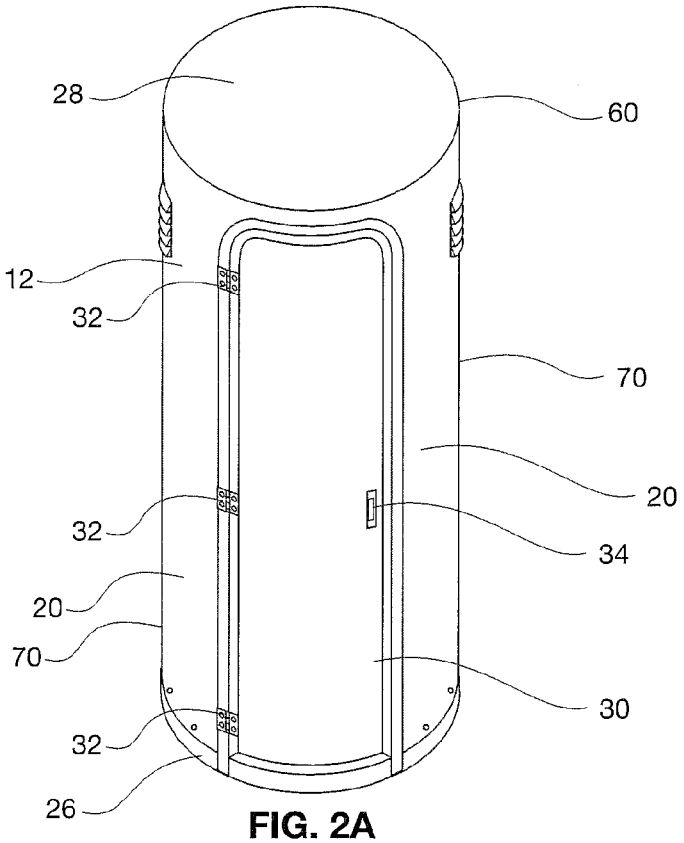
FIG. 2A is a front perspective view of the lower toilet shelter embodiment introduced in FIG. 1.

FIG. 2A shows one example of a lower toilet shelter 12 disassembled from the conical roof 14. In particular examples, the lower toilet shelter 12 is about ninety inches in height and about forty-two inches wide. The lower toilet shelter 12 may be a continuous plastic design with a total weight of about two hundred and twenty five pounds. Other examples include additional dimensions and weights. The lower toilet shelter 12 typically includes a structural support ceiling 28 to enclose the lower toilet shelter 12. The ceiling 28 may be weatherproof to protect the occupant from the elements regardless if the tapered roof 14 is secured thereto. As illustrated, the ceiling may further include a female shelter connector 60 around its periphery to mate with the corresponding male roof connector. Typically, the male connector traverses water away from the lower toilet shelter 12 when the elements are in the assembled position. However, in other embodiments, the male and female connectors may be reversed, i.e. the ceiling may include a male connector and the roof may include a female connector.

Figure 2B:
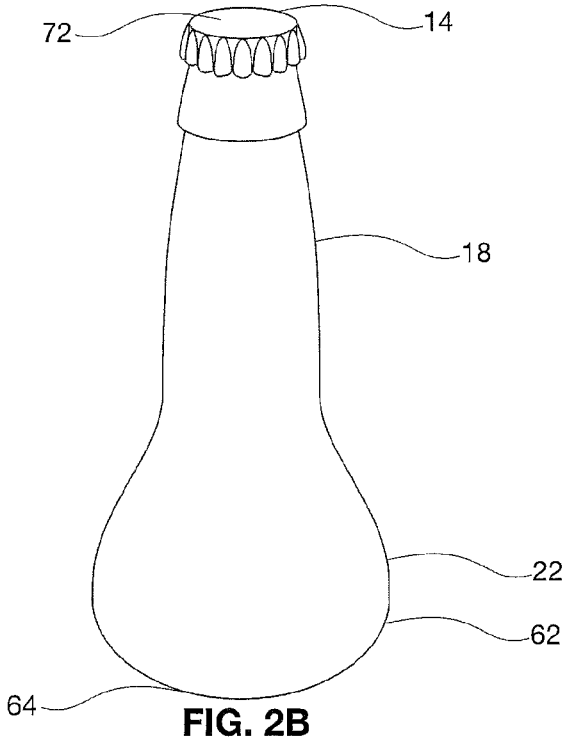
FIG. 2B is a side perspective view of the removable upper roof of the shelter embodiment introduced in FIG. 1.

FIG. 2B shows an isolated view of a roof 14 removed from the toilet shelter. As shown, the design of the roof 14 is generally conical with tapered edges. For instance, the tapered edge 18 is generally smaller in diameter than the lower squared edge 22. In particular examples, the diameter of the upper distal end may be about twenty inches, while the diameter of the proximate lower end may be about forty-two inches. Further, in some examples, the roof 14 is about thirty-six inches tall and the weight of the roof may be about twenty-seven pounds. However, additional examples include a variety of diameter arrangements to generally form any conical shape of the roof and/or different thicknesses and weights.

As illustrated in FIGS. 1 and 2A, the upper distal end of the roof 14 may have an upper roof wrap 72 on the substantially flat upper surface. In some examples, the upper roof wrap 72 provides advertising capabilities when viewed from above, for instance from a blimp or the like. The upper distal end of the roof 14 may also include a spiral rail along its periphery to simulate a screw top in a drinking bottle or the like. The lower proximate end of the roof 14 generally includes the squared edge 22 to mate with the toilet shelter. A male roof connector 62 along the periphery of the squared edge 22 may mate with any of the female shelter connectors shown or described herein. Typically, the interior 64 of the roof is hollow to allow a plurality of disassembled roofs to be stacked to reduce the footprint during storage and transport.

FIG. 3 introduces another embodiment of the portable toilet 100 that generally imitates the exterior appearance of a drinking can or the like. Portable toilet 100 includes a lower toilet shelter 12 having a tapered rounded, including cylindrical, sidewall 20 above its base 26. The tapered rounded sidewall 20 is similar to the portable toilet 10 embodiments shown and described herein, however the sidewall 20 of the portable toilets 100 includes an indented ledge 102 on the periphery of its upper end. Unlike the bottle embodiments, examples of the portable toilets 100 typically include a ribbed ceiling 104. The ribbed ceiling 104 is generally flat with ribs extending axially from a center tab 106 or the like. Other examples include a variety of ribbed arrangements to replicate other drinking cans. Similarly, other examples include a variety of center tab 106 orientations, including offset tabs in the ceiling, while yet other examples include no tab 106.

The rounded, including cylindrical, sidewall 20 is supported above a base 26 to fully enclose the shelter. The base 26 may be constructed of solid plastic and is generally adapted to be lifted, for instance by a forklift or the like, and positioned into place, including in position of any of the schematic arrangements shown and described herein. As illustrated, the outer face of the sidewall 20 may be flat or smooth to retain a removable, or permanent, body wrap 70. The body wrap 70 may fully, or partially, encircle the sidewall 20. In particular examples, body wrap 70 is removably secured to the sidewall, for instance with adhesives, fasteners and the like. In yet other examples, the body wrap 70 is inserted into a protective sleeve (not shown) along the sidewall 20.

Any of the body wrap 70 examples discussed herein may include advertisements, labeling, color or scenic schemes and the like to create a marketing and/or aesthetically-pleasing appearance.

The lower toilet shelter 12 includes a door 30. In some examples, the door opening is about seventy-five inches high and about twenty-six inches wide. The door 30 may be reversible, so as to allow both right-sided and left-sided entry, depending on the particular schematic arrangement. The door 30 may include one or a plurality of hinges 32, or the like, so that the door may be hingedly opened from one side. The hinges 32 may be fastened to the toilet shelter 12 with fasteners, but may also be integrally fastened thereto using a variety of thermoforming or heat lamination techniques. Further, the door 30 may include a handle 34. Again, the handle 34 may be repositionable along the door 30 to meet the particular usage, including any of the portable toilet schematic arrangements shown and described herein.

Figure 4:
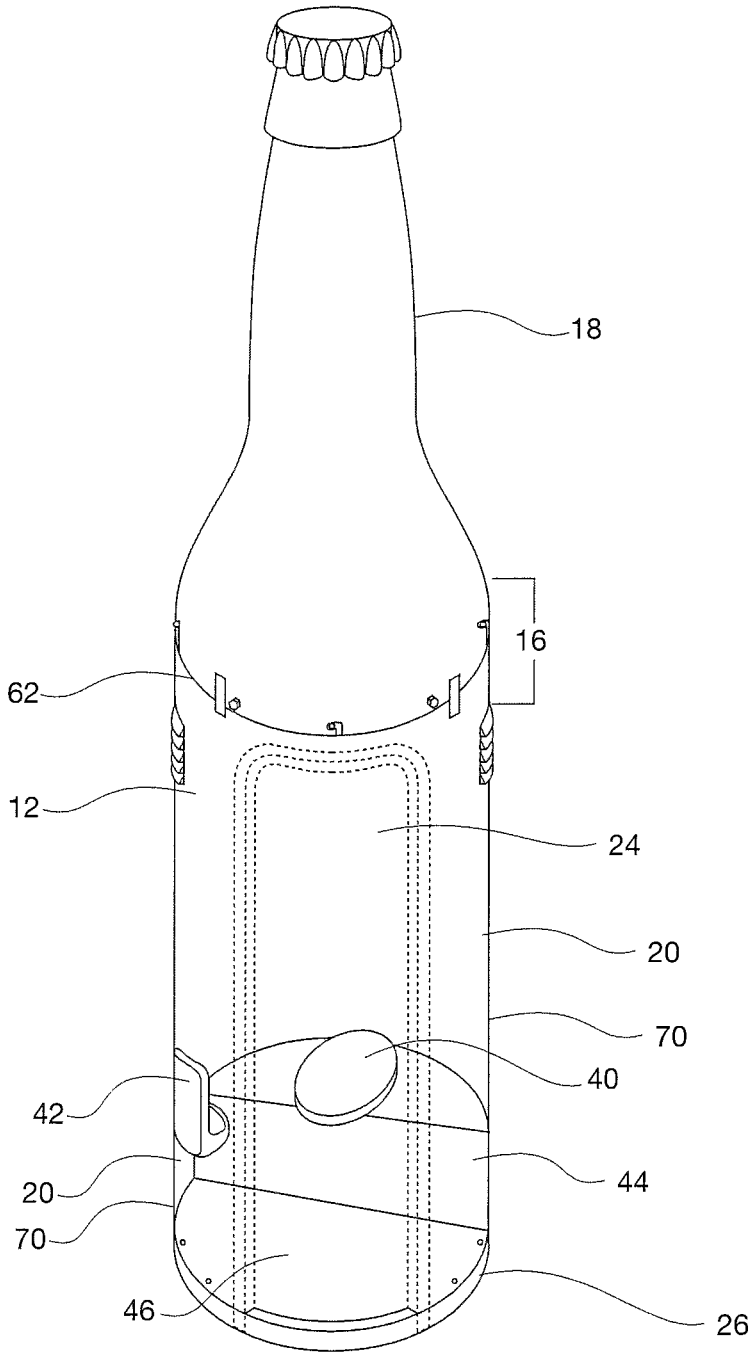
FIG. 4 is a front perspective view of the portable toilet according to FIG. 1, with portions omitted to show internal elements.
Figure 5:
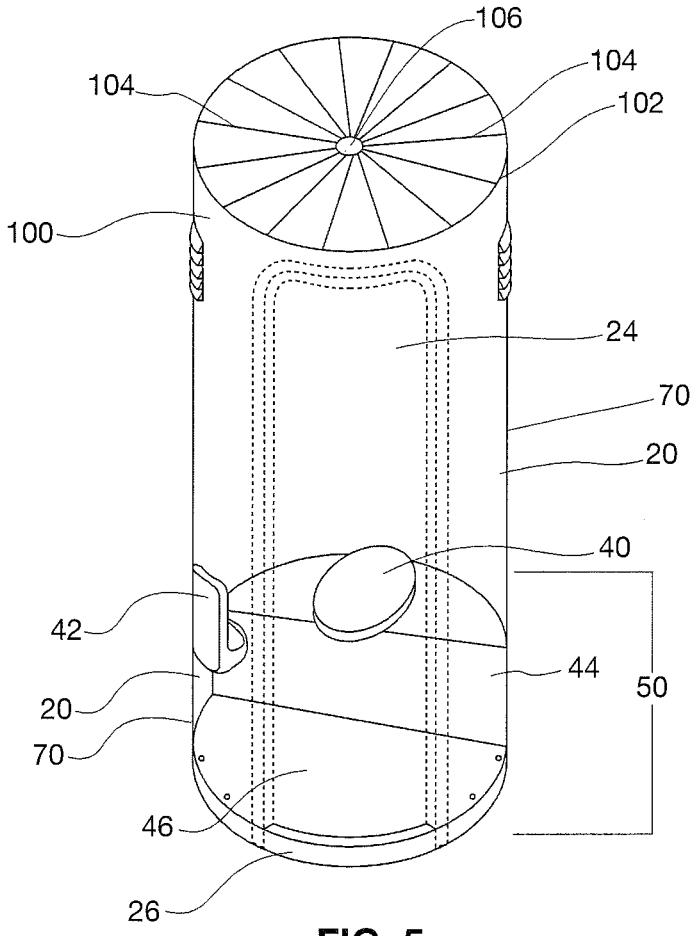
FIG. 5 is a front perspective view of the portable toilet according to FIG. 3, with portions omitted to show internal elements.

FIGS. 4 and 5 introduce elements of the interior housing 24 of the lower toilet shelters 12. As shown, each of the units may include a lower holding tank assembly 50. Typically, the holding tank includes a top wall, sidewalls and bottom wall to generally define a closed receptacle to receive and retain waste and chemicals. The lower holding tank may further include a removal port to drain and remove waste. A toilet seat 40 is mounted to the toilet unit 44 which is gravity fed to the holding tank assembly 50. In other examples, a urinal 42 is mounted either to a portion of the toilet unit 44, the base 26 or to the sidewall 20 in fluid communication with the holding tank assembly 50. The base 26 may be constructed of solid plastic and its upper surface may include a non-skid floor 46 as a sanitary top surface. In other examples, a potable water sink may be secured in the interior housing 24 in fluid communication with the holding tank assembly 50.

Figure 6:
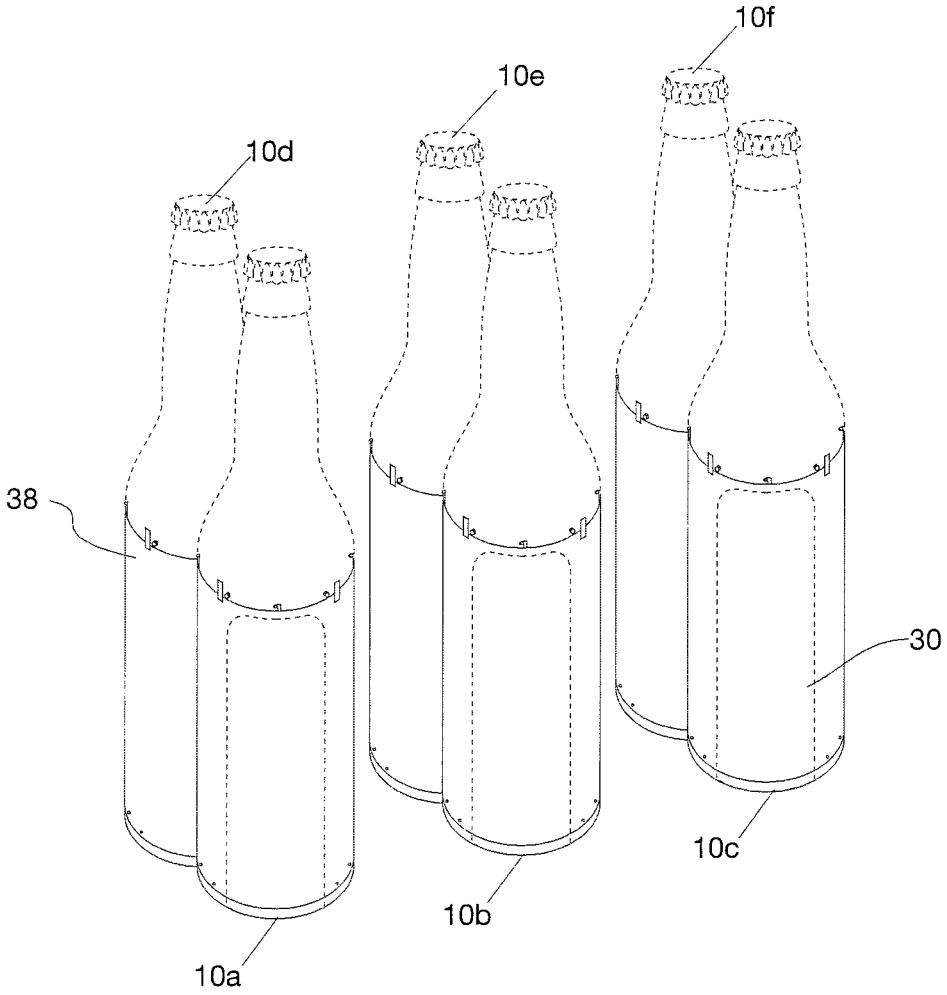
FIG. 6 is a schematic view of a portable restroom arrangement of one particular embodiment according to the disclosure.

Any of the portable toilets shown and described herein may be positioned along a generally flat surface for use in a variety of configurations for a portable restroom arrangement. Exemplary positioning includes rows of portable toilets aligned adjacent to one another replicating a 'six-pack' drink package design. FIG. 6 introduces one such particular schematic arrangement, wherein the six portable toilets 10*a*-10*f* are spaced apart from one another and positioned in two adjacent rows, for instance in three shelters per row. Other examples include fewer or greater than three shelters per row. Each door 30 is facing outward to allow convenient access, while the opposing face 38 of each portable toilets 10*a*-10*f* are spaced apart from one another and aligned back-to-back. The result is a unique schematic arrangement of a 'six-pack' design. In particular examples, any of the body wrap labels shown and described herein may draw attention to a particular advertising or labeling scheme. This portable toilet schematic may create an aesthetically-pleasing toilet arrangement, wherein patrons may designate the schematic as a landmark, for instance with directions "meet me at the 'X' vender six-pack." Those of ordinary skill in the art having the benefit of this disclosure will recognize other toilet schematics include any variety of arrangements replicating bottle- or can-grouping commercial packaging, including a 'twelve-pack', straight line, wine box, fast-food collection or the like.

In other embodiments, the disclosure includes a portable toilet kit or materials for assemblage. In this embodiment, the kit may comprise a lower toilet shelter 12, e.g. any of the toilet shelters previously shown or described. The kit may also comprise an upper roof 14, e.g. any of the roofs previously shown or described. In yet other examples, the kit may include a body wrap 70 and/or a roof wrap 72, e.g. any of the wraps previously shown or described.

Numerous characteristics and advantages have been set forth in the foregoing description, together with details of structure and function. Many of the novel features are pointed out in the appended claims. The disclosure, however, is illustrative only, and changes may be made in detail, especially in matters of shape, size, and arrangement of parts, within the principle of the disclosure, to the full extent indicated by the broad general meaning of the terms in which the general claims are expressed. It is further noted that, as used in this application, the singular forms "a," "an," and "the" include plural referents unless expressly and unequivocally limited to one referent.

What is claimed is:

1. A portable toilet comprising:

a lower toilet shelter having a rounded sidewall, the shelter including:

a closed receptacle holding tank;

a toilet seat aligned with the holding tank;

a door; and a weatherproof, substantially flat ceiling having a female shelter connector; and an ornamental roof having a male roof connector, wherein the male roof connector is positioned to mate with the female shelter connector to removably secure the ornamental roof to the lower toilet shelter, thereby defining a bottle shape in an assembled position, and defining a cylindrically shaped toilet assembly in an disassembled position.

2. The portable toilet of claim 1, wherein the rounded sidewall includes a smooth surface comprising an outer body wrap.

3. The portable toilet of claim 2, wherein an interior of the upper ornamental roof is hollow, thereby permitting a plurality of upper ornamental roofs to be stacked for transport or storage.

4. The portable toilet of claim 1, wherein the ornamental roof includes an upper tapered edge.

5. The portable toilet of claim 2, wherein the ornamental roof includes a lower squared edge.

6. The portable toilet of claim 1, further including a plurality of hinges on the door.

7. The portable toilet of claim 1, further including a urinal in fluid communication with said holding tank.

8. The portable toilet of claim 1, further including a non-skid floor material.

9. The portable toilet of claim 1, wherein a quick connect assembly further includes fasteners securing the lower toilet shelter and the ornamental roof.

10. A portable toilet comprising:

a lower toilet shelter comprising;

a rounded sidewall;

an indented ledge having a female shelter connector on the upper ends of the sidewall; and an exterior comprising:

a removable body wrap substantially enclosing the rounded sidewall; and a fastener adapted to removably secure the body wrap about the rounded sidewall, and wherein the rounded sidewall includes a door having at least one hinged side portion and an opposing opening side portion, and wherein the body wrap includes seams along the hinged side and opening side portions adapted to allow freedom of movement of the door about the rounded sidewall; and an ornamental roof having a male roof connector, wherein the male roof connector is positioned to mate with the female shelter connector to removably secure the ornamental roof to the lower toilet shelter, wherein the toilet has a first orientation when the roof is secured to the shelter to form a bottle shaped toilet assembly, and a second orientation when the roof is not secured to the shelter to form a cylindrically shaped toilet assembly.

11. The portable toilet exterior of claim 10, wherein the rounded sidewall includes a smooth surface.

12. The portable toilet exterior of claim 10, wherein the door is a reversible door adapted to move independent of the body wrap.

13. The portable toilet exterior of claim 10, wherein the body wrap encircles three hundred and sixty degrees of the rounded sidewall.

14. The portable toilet exterior of claim 10, wherein the fastener consists essentially of an adhesive.

15. The portable toilet of claim 10, wherein the ornamental roof the lower toilet shelter secure to form a bottle shaped portable toilet.

16. The portable toilet of claim 10, wherein an interior of the ornamental roof is hollow, thereby permitting stacking with other ornamental roofs for storage and transport.

17. A plurality of portable toilets each comprising:

a lower toilet shelter having a rounded sidewall, the shelter including:

a closed receptacle holding tank;

a toilet seat aligned with said holding tank;

a door; and a ceiling having a female shelter connector; and an ornamental roof having a male roof connector, wherein the male roof connector is adapted to removably align over the female shelter connector to form an ornamental shape, wherein the toilets have a first orientation when the roof is connected to the shelter to form a bottle shaped toilet assembly, and a second orientation when the roof is disconnected to the shelter to form a cylindrically shaped toilet assembly, and wherein an interior of the plurality of upper roofs are hollow and stackable for storage and transport.

18. The plurality of portable toilets of claim 17, wherein each ornamental roof is selected from a group comprising a beer-bottle roof and a wine-bottle roof, wherein the beer-bottle roof aligns with the ceiling to define a beer-bottle shape in an assembled position, and wherein the wine-bottle roof aligns with the ceiling to define a wine-bottle shape in an assembled position.

19. The plurality of portable toilets of claim 17, wherein the male roof connector is shaped to traverse water away from the lower toilet shelter.

20. The portable toilet of claim 1, wherein the male roof connector is shaped to traverse water away from the lower toilet shelter.

21. The portable toilet of claim 10, wherein the male roof connector is shaped to traverse water away from the lower toilet shelter.

22. A portable toilet comprising:

a lower toilet shelter having a rounded sidewall and a distal top, wherein the toilet has a first orientation in which an integrally formed ornamental roof portion defines a proximal bottom that is selectively received within the distal top of the lower toilet shelter to form a bottle shaped toilet assembly, wherein the toilet has a second orientation in which the lower toilet shelter has a waterproof top to form a cylindrically shaped toilet assembly, wherein a height of the ornamental roof portion is about the same as the height of the lower toilet shelter.

* * * * *